US006123567A

United States Patent [19]

McCarthy

[11] Patent Number: 6,123,567

[45] Date of Patent: *Sep. 26, 2000

[54] COAXIAL CABLE CONNECTOR

[75] Inventor: Dale C. McCarthy, Pensacola, Fla.

[73] Assignee: Centerpin Technology, Inc., Gulf Breeze, Fla.

[ * ] Notice: This patent is subject to a terminal disclaimer.

[21] Appl. No.: 09/111,019

[22] Filed: Jul. 7, 1998

Related U.S. Application Data

[60] Continuation-in-part of application No. 09/038,028, Mar. 11, 1998, which is a division of application No. 08/647,735, May 15, 1996, Pat. No. 5,775,934.

[51] Int. Cl.[7] ..... H01R 13/00

[52] U.S. Cl. ..... 439/427; 439/932; 439/584

[58] Field of Search ..... 439/427, 504, 439/578–583, 585; 29/33 M, 747, 748, 866, 857

[56] References Cited

U.S. PATENT DOCUMENTS

| | | | |
|---|---|---|---|
| 2,647,246 | 2/1953 | Gilbert | 339/99 |
| 2,719,957 | 10/1955 | Abbott | 339/99 |
| 2,839,595 | 6/1958 | Felts et al. | 439/427 |
| 2,887,667 | 5/1959 | Wolfe et al. | 439/427 |
| 3,411,129 | 11/1968 | Peters | 339/140 |
| 3,683,320 | 8/1972 | Woods et al. | 339/177 E |
| 3,744,007 | 7/1973 | Horak | 339/97 R |
| 4,013,333 | 3/1977 | Chang | 439/427 |
| 4,178,054 | 12/1979 | Laudig | 339/95 R |
| 4,261,632 | 4/1981 | Narozny | 339/97 C |
| 4,339,166 | 7/1982 | Dayton | 339/100 |
| 4,561,179 | 12/1985 | Brush, Jr. et al. | 29/866 |
| 4,696,908 | 9/1987 | Gutter et al. | 439/98 |
| 4,708,414 | 11/1987 | Lam | 439/394 |
| 4,722,579 | 2/1988 | Cummings et al. | 439/391 |
| 4,739,126 | 4/1988 | Gutter et al. | 174/65 |
| 4,759,722 | 7/1988 | Song | 439/394 |
| 4,770,642 | 9/1988 | Van Hoose | 439/127 |
| 4,786,760 | 11/1988 | Friedhelm | 439/427 |
| 4,968,268 | 11/1990 | Oh | 439/111 |
| 5,066,248 | 11/1991 | Gaver, Jr. et al. | 439/578 |
| 5,263,878 | 11/1993 | Lai | 439/656 |
| 5,318,458 | 6/1994 | Thörner | 439/427 |
| 5,362,251 | 11/1994 | Bielak | 439/394 |
| 5,403,201 | 4/1995 | McCarthy | 439/427 |
| 5,503,568 | 4/1996 | Pryce | 439/427 |
| 5,569,049 | 10/1996 | Tatebe et al. | 439/394 |
| 5,607,320 | 3/1997 | Wright | 439/394 |

FOREIGN PATENT DOCUMENTS 0178775 4/1962 Sweden .

*Primary Examiner*—Hien Vu

*Attorney, Agent, or Firm*—Saliwanchik, Lloyd & Saliwanchik

[57] ABSTRACT

An electrical connector for coupling to a coaxial cable of the type having an inner conductor enclosed in an inner concentric insulation and having a generally concentric conductive sheath therearound and an outer insulation enclosing the conductive sheath. The connector has a housing having an electrically conductive portion and a bore therein. An electrically conductive pin has one end protruding axially into the housing bore and the second prong end extending in an opposite direction within a second housing bore. One or more conductive arms are electrically connected to the conductive housing portion and insulated from the electrical conductive prong and having pointed ends sized for driving the clamp into the outer insulation and into the conductive sheath without contacting the center conductor. A closure member for enforcing engagement of the pointed ends of the conductive arms into the outer insulation.

26 Claims, 2 Drawing Sheets

COAXIAL CABLE CONNECTOR

RELATED APPLICATION

This is a Continuation-in-Part of prior U.S. patent application Ser. No. 09/038,028 filed on Mar. 11, 1998, which is in turn a division of U.S. patent application Ser. No. 08/647,735, filed on May 15, 1996, for a "Coaxial Cable Connector" and is now U.S. Pat. No. 5,775,934.

TECHNICAL FIELD

The present invention relates generally to electrical connectors. More particularly, the present invention relates to an electrical connector for coupling to an insulated electrical coaxial cable or wire. Specifically, the present invention relates to an electrical connector which is coupled to an insulated coaxial cable without being required to strip the insulation from the end of the insulated coaxial cable.

BACKGROUND OF THE INVENTION

In the past, a wide variety of electrical wire connectors have been provided for connecting to wire ends. In a typical connector, the end of the wire is stripped of insulation and the bare wire is inserted into a connector where it can be soldered or clamped or otherwise attached to the connector. It is also common to tin the wire ends by coating the wire end with solder and a wide variety of connectors have been provided which removably hold the wire to the connector.

Typical connectors are seen in audio systems, such as hi-fi speakers, in which a wire end is stripped of the insulation and is inserted in an opening and a threaded nut is threaded down onto the wire. The nut can be loosened for removing the wire. Other audio speakers include spring clamps which allow a wire end to be stripped of insulation and inserted into an opening while lifting the spring connector clamp and then releasing the spring connector clamp onto the wire. Other commonly used connectors allow a stripped wire end to be inserted into a connector or into both ends of a connector and then clamped with pliers to collapse a conductive sleeve onto the wire. This type of connector is made of a malleable metal such that collapsing the connector onto the stripped wire end provides the necessary electrical contact. The environment in which the connector is used will determine if the exterior of the connector will need to be insulated.

In contrast to these various types of wire connectors, the present invention deals with a wire connector that does not require the insulation to be stripped and also provides, in some embodiments, for the insertion of the insulated wire end in a manner to lock the wire end in place inside the bore of a wire connector.

Prior wire connectors can be seen in the following U.S. patents. The Chang U.S. Pat. No. 4,013,333 for a wire connector having two concentric sockets adapted to be assembled one into the other and in which the inner socket has a conductive needle mounted therein for sliding a wire end into each end of the connector and which also uses a spike pressed in two holes in the sleeves to penetrate the coating of the wire ends.

In the Danner U.S. Pat. No. 3,860,320, a dangler cathode cable assembly is connected to a ball-like cathode member by stripping the end portion of the cable and inserting the end portion into a sleeve which is pressed into an undersized tapered socket that has a pointed pin therein.

In the Friedhelm U.S. Pat. No. 4,786,760, a cable connector for a piezoelectric cable has an insulated cable end which is inserted into a sleeve.

In the Berman U.S. Pat. No. 4,091,233, an electrical cable to the connector is provided for connecting one or more insulated electrical cords or cables together. The insulated cable ends can be inserted into the receptacles on either end and onto a prong of electrically conductive material so that the prong is an electrical contact with the wire of an insulated cord end. A container of adhesive material on the end of the receptacle is released from the container to create a physical bond between the cord and the connector to hold the cord within the connector.

In my prior U.S. Pat. No. 5,403,201, an electrical connector is coupled to an insulated electrical conductor without striping the end of the insulated conductor. The insulated wire is held with a spring clamp which allows the wire to be released.

U.S. patents directed to other structural arrangements for electrical connectors are exemplified, for example, by the Homolka U.S. Pat. No. 5,052,946, directed to a plug connector for a high voltage coaxial cable which uses a plug in contact for the connection with the central conductor. In the Komada U.S. Pat. No. 4,352,240, a method of connecting a coaxial cable to an electrical connector is provided which drives a pin shaped positive terminal into the center conductor. The Gerhard U.S. Pat. No. 3,444,507 is for an electrical connector for semi-solid conductors; the Caulkins U.S. Pat. No. 3,951,503 is a cable splice assembly for multiconductor cables; and the W. C. Gourley et al. U.S. Pat. No. 3,317,883 is for a high voltage wire coupling having a pair of prongs for coupling to the center conductor of insulated wires.

The present invention utilizes an electrical connector for coupling to an insulated electrical coaxial cable end wherein the coaxial cable is inserted into a bore in the connector housing so as to drive a prong located therein into the cable end. The cable is then releasably clamped through the insulation of the cable with conductive clamps which extend into the conductive sheath to thereby form a coupling to the center conductor and separately to the conductive sheaf.

SUMMARY OF THE INVENTION

It is a primary object of the present invention to provide an improved coaxial cable connector.

In one aspect of the invention, the improved coaxial cable connector has a housing with a central bore and a center wall separating two ends of the bore into opposing first and second chambers.

In another aspect of the invention, the improved coaxial cable connector includes a center electrical conductor extending through the wall of the housing into both chambers of the bore. The central conductor has a conducting stem with a pointed end extending axially into the first chamber for making electrical contact with the center conductor of a coaxial cable and a cylindrical portion extending axially into the second chamber.

In another aspect of the invention, the improved coaxial cable connector includes electrical conductive arms which extend axially from the housing at the end of the first chamber. The arms each terminate in pointed ends which are pointed radially and are adapted to pierce the outer insulation of a coaxial cable and to make electrical contact with the conductive sheath thereunder.

In still another aspect of the invention, the improved coaxial cable connector includes a closure member for attachment to the housing at the end of the first chamber and which overlies the conductive arms to enforce electrical contact with the conductive sheath at the pointed ends.

In a further aspect of the invention, the closure member may be a cover secured to the housing by threading engagement or by an interference fit or snap fit as may be convenient and includes a frusto-conical inner surface which engages the conductive arms and urges the pointed ends to pierce the outer insulation and engage the conductive sheath of the coaxial cable.

In a further aspect of the invention, the closure member may be a heat shrinkable sleeve which grips the housing and overlies the conductive arms and coaxial cable to enforce piercing of the outer insulation of the coaxial cable by the conductive arms when subject to a requisite heat shrink temperature.

In a further aspect of the invention, a coaxial cable with a central conductor and a concentric insulator overlaid by a concentric conductive sheath and an outer insulation is inserted through the closure member and into the first chamber of the housing and forced onto and over the pointed end of the central conductor so as to establish electrical conductive contact therebetween. The pointed end of the conductive arm is pressed into piercing engagement with the outer insulation of the coaxial cable to make electrical conductive contact with the conductive sheath thereunder, and the closure member is secured to the housing so as to enforce the conductive contact of the conductive arm with the conductive sheath of the coaxial cable.

In still a further aspect of the invention, a coaxial cable with a central conductor and a concentric insulator overlaid by a concentric conductive sheath and an outer insulation is inserted through the aperture into the cap and into the first chamber of the housing and forced onto and over the pointed end of the central conductor so as to establish electrical conductive contact therebetween, and the cap is installed onto the housing to engage the conductive arms and to force piercing of the outer insulation and to make electrical contact at the pointed ends of the concentric conductive sheath of the cable.

These and other objects of the invention as well as the advantages thereof over existing and prior art forms, which will be apparent in view of the following detailed specification, are accomplished by means hereinafter described an claimed.

In general, a novel electrical connector embodying the concepts of the present invention is intended for coupling to a coaxial cable having a central conductor, an adjacent concentric insulator, a generally concentric outer conductive sheath, and an outer insulation enclosing the conductive sheath.

In one embodiment of the invention, the connector is made up of a housing having a central bore, an electrically conductive pin that is disposed in the bore, one or more conductive arms which extend axially from one end of the housing and an aperture housing cap that receives the coaxial cable and cooperates with the conductive arms, the cable and the one end of the housing to establish electrical contact with the central conductor and conductive sheath of the cable and to maintain the cable in position in the connector.

The housing is electrically conductive and includes an electrically insulating annular wall which separates the bore into oppositely disposed first and second chambers.

The electrically conductive pin is mounted in the annular wall. The pin has one pointed end protruding axially from the wall into the first chamber of the housing bore and an opposite end extending from the wall in the opposite direction into the second chamber.

One or more conductive arms are electrically connected to and extend axially from the periphery of the housing at the end of the first chamber. The arms have pointed ends sized to be driven through the outer insulation and into the conductive sheath of the coaxial cable without contacting the center conductor.

The housing cap includes an aperture for receiving a coaxial cable therethrough and is desired to be secured to the end of the hosing at the first chamber by threading a snap fit, a force fit, or an equivalent means. The interior surface of the cap may also have a frusto-conical wedging surface for driving and holding the conductive pointed ends through the outer insulation and into electrical contact with the conductive sheath of the cable. The frusto-conical wedging surface also forces the clamps into frictional engagement with the outer insulation to assist the pointed ends in holding the coaxial cable within the connector.

In practice, the coaxial cable is threaded through the housing cap and inserted into the first chamber of the housing. The cable is driven onto the pointed end of the pin in the chamber thereby establishing electrical contact between the pin and the center conductor of the cable. Thereupon the conductive arms are clamped onto the coaxial cable so as to make their pointed ends pierce the insulation cover and to make engagement with the conductive sheath thereunder. The clamping may be accomplished manually by hand or with a tool, or by relying upon the welding action of the frusto-conical surface of the housing cap against the conductive arms of the cap secured to the housing. A second embodiment of the invention replaces the housing cap with a heat shrinkable insulation.

One preferred embodiment of a connector in accordance with the invention that illustrates the best mode contemplated for putting it in practice is described herein with reference to the annexed drawings that form a part of the specification. However, this description does not attempt to show all of the forms and modifications in which the invention might be embodied. As such, the embodiment shown and described herein is illustrative and can be modified without departing from the spirit and scope of the invention particularly as set forth in the claims that form a part hereof.

DESCRIPTION OF AN EXEMPLARY EMBODIMENT

Figure 1:
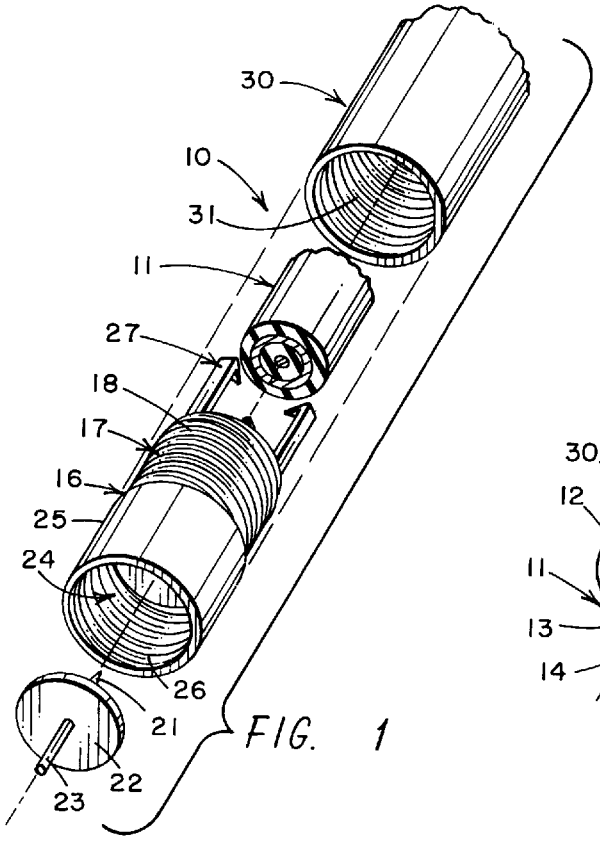
FIG. 1 is an exploded view of an electrical connector and a portion of a coaxial cable in accordance with the present invention.
Figure 2:
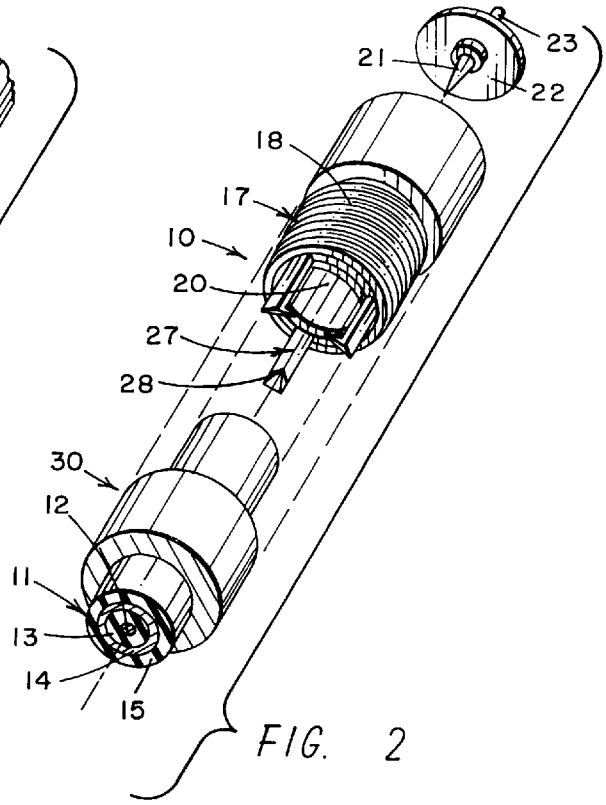
FIG. 2 is an exploded view of the electrical connector of FIG. 1 but looking in the opposite direction and having the coaxial cable inserted into the housing cap which has been sectioned for clarity.

Referring to FIGS. 1–4 of the drawings, an electrical connector 10 in accordance with the invention, especially adapted for use with a coaxial cable 11, is illustrated. The coaxial cable 11 has circumferentially disposed components including: a center conductor 12, a concentric insulation 13 surrounding the center conductor 12; a concentric conductive wire braid or sheath 14 surrounding the insulation 13; and an outer insulation 15 covering the conductive sheath 14. The connector 10 can connect various types and sizes of coaxial cables to a variety of plugs, jacks, and connectors, all referred to herein as electrical connectors, and as illustrated here, the connector 10 of the male part of 75 ohm coaxial F-connector. Connection of the coaxial cable 11 to the connector 10 is accomplished without solder and without the need to strip the insulation cover 15 from the cable.

The coaxial cable 11 as connected to an electrical apparatus, such as a television set, requires that the center conductor 12 and the outer sheath 14 be electrically coupled separately and insulated from one another to another connector. In accomplishing that purpose, the connector 10 includes a connector housing 16 having a cylindrical cable attaching portion 17 with external threads 18 defining a first chamber 20 and a cylindrical housing portion 25 with internal threads 26 defining a second chamber 24.

Figure 3:
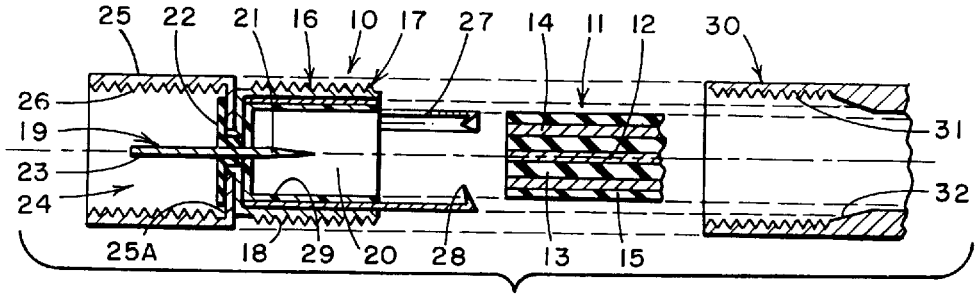
FIG. 3 is a sectional exploded view of the electrical connector of FIGS. 1 and 2.
Figure 4:
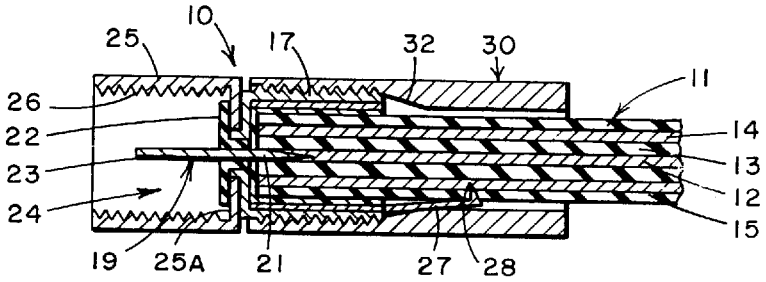
FIG. 4 is a sectional view of the electrical connector having a coaxial cable end attached thereto.

An electrically conductive pin 19 is mounted to an insulation base 22 within the housing 25 with the base 22 abutting and being secured to a wall portion 25A. The conductive pin 19 has a tapered prong 21 extending axially into the bore defining the first chamber 20 and also has a cylindrical prong 23 extending axially into the bore defining the second chamber 24. Electrically conductive arms 27 extend axially from the cable attaching portion 17 of the housing 16. Each arm has pointed contacts 28 which are also electrically conductive. A plurality of clamping arms 27 are contemplated but a single arm can perform the operation of attaching the coaxial cable 11. A locking cover 30 is a generally cylindrical conductive member having internal threads 31 adapted to engage the external threads 18 of the connector body portion 17. The cap 30 has a central bore to receive the coaxial cable and an annular, frusto-conically angled wedging portion 32 formed therein. FIG. 3 also shows a cup-shaped insulation covering 29 received within the connector housing 16 which provides extra security against contact of the conductive sheath 14 with the connector body 16 metal portions in the event a stray strand of wire from conductive sheath 14 should extend from the cable 11.

In operation, the tip of the coaxial cable 11 does not have any of the insulation stripped from the conductors 12 or 14 as is normally required to connect a coaxial cable to a connector. The undisturbed end of the coaxial cable 11 is slidably inserted between the clamping members 27 and into the bore 20. Sufficient force is provided to push the cable 11 onto the prong 21 and into electrical contact with the center conductor 12. The electrical conductive contact with the coupling stem portion 19 provides electrical continuity to the probe 23. The connector 10 can then be attached to an electrical apparatus, such as a television set or the like, or to another coaxial cable.

Once the coaxial cable 11 is pushed into the bore and attached into electrical contact with the prong 21, the ends of the arms 27 may be clamped to drive the pointed contacts 28 through the outer insulation 15 into the conductive sheath 14. This may be accomplished manually, by hand or with pliers, in clamping the ends of the arms 27 to force the pointed contacts 28 through the outer insulaitno 15 of the coaxial cable 11 into the concentric conductive sheath 14 to make an electrical contact therewith. Alternatively, and in carrying out the same function, the ends of the arms 27 may be clamped by installing the housing cap 30 onto the threads 18 of the housing portion 17 so that wedging portion 32 drives against the ends of the clamps to drive the pointed contacts 28 through the outer insulation 15 and into the conductive sheath 14. If done manually, the next step is to maintain the cable and the arms 27 in contact by threading the cap into place or utilizing the heat shrink embodiment, as shown in FIGS. 5, 6 and 7.

Figure 5:
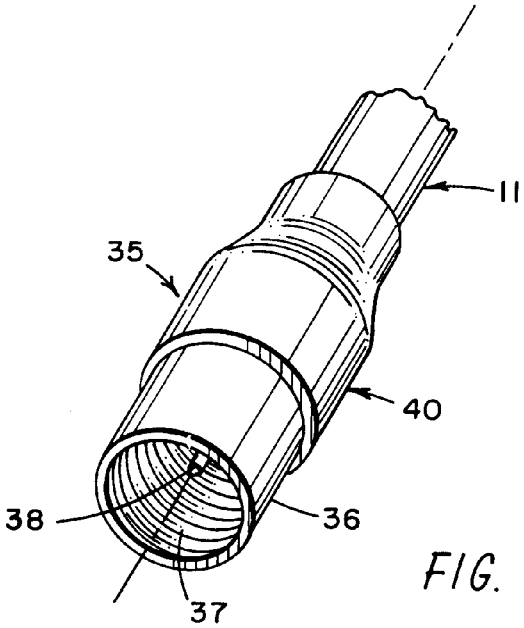
FIG. 5 is a perspective view of another embodiment of a coaxial cable connector in accordance with the present invention.
Figure 6:
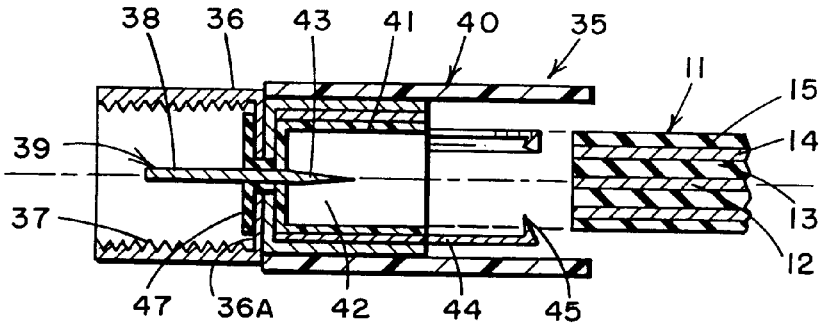
FIG. 6 is an exploded sectional view of the connection of FIG. 5.
Figure 7:
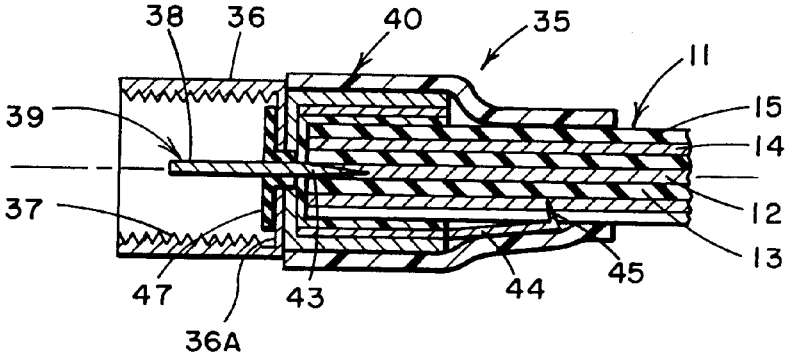
FIG. 7 is a sectional view of the embodiment of FIGS. 5 and 6 having the cable attached thereto.

Turning now to FIGS. 5, 6 and 7, another embodiment of a coaxial cable connector is illustrated in which an electrical connector 35 has an electrically conducting connector body 36. In FIG. 7, the connector 35 has a coaxial cable 11 attached to one end thereof. The other end of the connector 35 has internal threads 27 with a center conductor 39 having a cylindrical conductor portion 38. In this embodiment, a heat shrinkable insulating sleeve 40 is attached to the conductive connector housing portion 41. A pointed prong 43 on the stem 39 is disposed in a chamber 42. The pointed prong 43 is provided for insertion into electrical contact with the center conductor 12 of a coaxial cable 11. A plurality of clamping arms 44 are connected to the conductive housing 41 and each arm 44 has a pointed prong 45 extending radially inward form the end thereof.

Coaxial cable 11 has electrical insulation 13 around the center conductor 12 which is covered by the concentric conductive sheath 14 which in turn is wrapped in insulation cover 15. In operation, the coaxial cable 11 end is inserted into an opening 46 in the insulation 40 between the clamping arms 44 and prongs 45. The prong 43 is driven into or continuously adjacent the center conductor 12 thereby making electrical contact therewith.

The center conductor 12 on coaxial cable is sometimes a single conductor wire and sometimes is formed of multiple stands so that the prong 43 will sometimes be driven into the multiple strand wire and at other times be directed adjacent to the single wire conductor 12.

Once the cable 11 is inserted and is in conductive contact with the prong, the arms 44 are clamped manually by hand or with a tool so as to cause the pointed prongs 45 to pierce the outer insulation 15 and make conductive contact with the conductive sheath 14. Alternatively, the heat shrinkable insulation 40 is heated which causes it to shrink tightly onto the housing 41 on onto the cable 11 and the arms 44. This shrinkage can push the pointed prongs 45 of arms 44 through the outer cover 15 and into electrical contact with the conductor member 14. In the case of the alternative and to further assure proper contact, the insulation 40 can be pressed by the assembler onto the clamp members 44 to set the prongs 45 through the insulation 15 and into the conductor 14. The insulating sleeve 40 thus holds the connector 35 to the cable 11 while forming an insulation for the tip of the cable. The arms 44 also lock into the cover 15 to hold the cable in place with the conductive prong 43 making contact with the conductor 12 of the cable 11. This provides the center conductor 38 with a contact with the cable 11. The prongs 38 and 43 are mounted to an insulating member 47 which is attached to a wall 36A of the body 36.

While only two preferred embodiments of my present invention are disclosed, it is to be clearly understood that an improved electrical connector for a coax cable has been provided. The structure advantageously allows the coaxial cable to be attached to the connector without stripping or removing any of the insulation on the ends of the cable while providing a complete electrical connection to the center conductor and the conductive ground sheath. The concepts of the present invention are susceptible to numerous changes which will, in view of the foregoing disclosure, become apparent to one skilled in the art. Therefore, the scope of the present invention is not to be limited to the details shown and described but is intended to include all changes and modifications which come within the scope of the appended claims.

What is claimed is:

1. An electrical connector for coupling to an electrical conductor of the type having an inner conductor enclosed with an inner insulation and a generally concentric conductive sheath around said inner insulation and enclosed in an outer insulation, said electrical connector comprising:

a housing having an electrically conductive portion and a bore therein;

at least one electrically conductive prong having two end portions, said conductive prong attached to said housing and having an portion protruding axially into said housing bore piercing into an end of the electrical conductor and making electrical contact with the inner conductor of the electrical conductor;

an electrically conductive clamp electrically connected to, and extending outwardly from a front end of, said electrically conductive portion of said housing and insulated from said electrically conductive prong, said electrically conductive clamp having a pointed end sized for driving through the outer insulation of the electrical conductor and making electrical contact with the conductive sheath without contacting the inner conductor;

a generally cylindrically shaped housing cap member attachable to said housing and having means for driving said electrically conductive clamp through the outer insulation of the electrical conductor to make electrical contact with the conductive sheath when said cap member is attached to said housing to thereby form a conductive path between the conductive sheath and the electrically conductive portion of said housing.

2. An electrical connector for coupling to an electrical conductor in accordance with claim 1 in which said cap member has a tapered portion therein for driving said electrically conductive clamp through the outer insulation of the electrical conductor and making electrical contact with the conductive sheath.

3. An electrical connector for coupling to an electrical conductor in accordance with claim 1 in which said cap member is threaded for threaded attachment to said housing.

4. An electrical connector for coupling to an electrical conductor in accordance with claim 3 in which said cap member has a generally cylindrical portion having internal threads and said housing having a generally cylindrical portion having external threads whereby said cap member can be threaded onto said threaded housing portion.

5. An electrical connector for coupling to an electrical conductor in accordance with claim 1 in which said electrical connector has a plurality of electrically conductive clamps.

6. An electrical connector for coupling to an electrical conductor in accordance with claim 5 in which said electrically conductive prong is attached to an electrically insulated housing portion.

7. An electrical connector for coupling to an electrical conductor in accordance with claim 6 in which said housing comprises a second housing and said electrically conductive prong has a second end portion extending into said second housing bore.

8. An electrical connector for coupling to an electrical conductor in accordance with claim 7 in which said housing has an attaching portion adjacent said second bore for attaching second end portion of said prong to another electrical connector.

9. An electrical connector for coupling to an electrical conductor in accordance with claim 8 in which said housing attaching portion includes a threaded portion for threadably attaching said electrical connector to the other electrical connector.

10. An electrical connector for coupling to an electrical conductor in accordance with claim 9 in which said housing comprises an insulating plate having said prong attached therethrough attached inside said housing between said first and second bores, each bore extending from an end of said housing.

11. An electrical connector for coupling to an electrical conductor in accordance with claim 10 in which said housing is generally cylindrical shaped.

12. An electrical connector for coupling to an electrical conductor in accordance with claim 10 in which said conductive clamps are metal clamps attached to a metal housing portion.

13. An electrical connector for coupling to an electrical conductor in accordance with claim 10 in which said housing bore has an electrically insulating lining therein.

14. A connector attachable to a coaxial cable having an inner central conductor and an outer concentrically disposed conductor separated by a concentrically disposed insulation layer and enclosed in an outer insulation, said connector comprising:

a housing having a central, substantially cylindrical opening, a wall separating said opening to define first and second chambers, and a conductive arm extending outwardly from a front end of said housing at said first chamber;

said conductive arm having an end contact portion extending substantially radially inwardly and including a piercing structure;

an axially extending pin member and an insulating body secured to said pin member, said insulating body being secured centrally in said housing in abutment with said wall, said pin extending into said first and second chambers;

said pin member having a pointed end portion for piercing into an end of the electrical conductor and making electrical contact with the inner central conductor; and a generally cylindrically shaped cover member, surrounding and extending beyond the cylindrical opening of said housing at said first chamber, said cover member having means for abutting said conductive arm and urging said arm radially inwardly to cause said contact portion to pierce the outer insulation of the coaxial cable and establish electrical contact with the outer concentrically disposed conductor when the coaxial cable is positioned in said first chamber.

15. A method of coupling an electrical connector to a coaxial cable of the type having an inner conductor enclosed with an inner insulation and a conductive sheath around the inner insulation and enclosed in an outer insulation wherein:

the electrical connector includes:

a housing having an electrically conductive portion and a bore portion;

an electrically conductive pin, said electrically conductive pin attached to said housing such as to be electrically isolated from said electrically conductive housing portion and protruding into said housing bore for contacting the inner conductor of the electrical conductor;

an electrically conductive arm electrically connected to said electrically conductive housing portion and insulated from said electrically conductive pin, said electrically conductive arm extending outwardly from a front end of said housing and having a pointed end adapted for driving into an outer insulation of the electrical conductor and making electrical contact with the conductive sheath of the electrical conductor; and a generally cylindrically shaped cover member, having an aperture for receiving a coaxial cable and which is attachable to the housing, said cover member having means for engaging the electrical conductive arm and maintaining the arm in contact with the conductive sheath of the cable;

said method comprising the steps of:

a. inserting the coaxial cable through the aperture in the cover member;

b. threading the coaxial cable past the electrically conductive arm and into electrically conductive engagement at the inner conductor with the end of the electrically conductive pin protruding into the housing bore;

c. driving the pointed end of the electrically conductive arm through the outer insulation and making electrical contact with the conductive sheath of the coaxial cable; and d. attaching the cover member to the housing and over the conductive arm so as to maintain the electrically conductive arm in electrical contact with the conductive sheath through the outer insulation of the coaxial cable;

whereby the coaxial cable is secured in place with the connector and electrical contact is made with the cable at the inner conductor and at the conductive sheath.

16. The method according to claim 15 wherein:

the step of driving the pointed end of the electrically conductive arm through the outer insulation and making electrical contact with the conductive sheath of the coaxial cable is accomplished manually.

17. The method according to claim 15 wherein:

the cover member is a housing cap.

18. The method according to claim 17, wherein:

the housing cap includes an internal annular wedging portion adapted for engaging the electrically conductive arm, wherein the means for engaging the electrical conductive arm and maintaining the arm in contact with the conductive sheath of the cable is the internal annular wedging portion of said housing cap and wherein:

the step of driving the pointed end of the electrically conductive arm through the outer insulation and making electrical contact with the conductive sheath of the coaxial cable is accomplished manually, and wherein:

the step of attaching the housing cap to the housing includes the internal annular wedging portion of the housing cap forcibly engaging the electrically conductive arm.

19. The method according to claim 17, wherein:

said housing cap includes an internal annular wedging portion adapted for engaging the electrically conductive arm, wherein the means for engaging the electrical conductive arm and maintaining the arm in contact with the conductive sheath of the cable is the internal annular wedging portion of said housing cap and wherein:

the step of driving the pointed end of the electrically conductive arm through the outer insulation and making electrical contact with the conductive sheath of the coaxial cable comprises moving the housing cap toward the housing thereby engaging the internal annular wedging portion against the outer surface of the electrically conductive arm and driving the pointed end of the electrically conductive arm through the outer insulation and making electrical contact with the conductive sheath of the coaxial cable.

20. The method according to claim 18, wherein:

the housing cap and housing are threaded so as to receive one another and wherein:

the step of attaching the housing cap to the housing includes threading the housing cap onto the housing.

21. The method according to claim 18, wherein:

the housing cap and housing are sized so as to provide a locking fit when mutually engaged and wherein:

the step of attaching the housing cap to the housing includes forcing the housing cap and housing into mutual engagement so as to form a locking fit.

22. The method according to claim 19, wherein:

the step of attaching the housing cap to the housing includes the internal annular wedging portion of the housing cap forcible engaging the electrically conductive arm.

23. The method according to claim 15, wherein:

the cover member is a heat shrink sleeve having an aperture for receiving a coaxial cable and being of a dimension to fit over the housing and over the electrically conductive arm, and wherein the means for engaging the electrical conductive arm and maintaining the arm in contact with the conductive sheath of the cable is the shrinking action of the heat shrink sleeve upon heat treating of the heat shrink sleeve.

24. The method according to claim 23, wherein:

the step of driving the pointed end of the electrically conductive arm through the outer insulation and making electrical contact with the conductive sheath of the coaxial cable is accomplished manually, and wherein:

the step of attaching the heat shrink sleeve to the housing includes placing the heat shrink sleeve over the housing and over the electrically conductive arm and heat treating the heat shrink sleeve so as to shrink the sleeve into engagement with the housing and with the electrically conductive arm.

25. The method according to claim 23, wherein:

the step of driving the pointed end of the electrically conductive arm through the outer insulation and making electrical contact with the conductive sheath of the coaxial cable comprises placing the heat shrink sleeve over the housing and over the electrically conductive arm and heating the sleeve so as to shrink the sleeve on the conductive arm and drive the pointed end of the electrically conductive arm through the outer insulation and make electrical contact with the conductive sheath of the coaxial cable, and wherein:

the step of attaching the heat shrink sleeve to the housing and over the conductive arm so as to maintain said arm in electrical contact with the conductive sheath through the outer insulation of the coaxial cable comprises further heating the heat shrink sleeve so as to shrink and attach the sleeve to the housing, conductive arm, and cable and to maintain the conductive arm in electrical contact with the conductive sheath through the outer insulation of the coaxial cable.

26. The method according to claim 23, wherein:

the step of driving the pointed end of the electrically conductive arm through the outer insulation and making electrical contact with the conductive sheath of the coaxial cable and the step of attaching the heat shrink sleeve to the housing are combined and include placing the heat shrink sleeve over the housing and over the electrically conductive arm and heat treating the heat shrink sleeve so as to shrink the sleeve into engagement with the housing and with the electrically conductive arm.

* * * * *

UNITED STATES PATENT AND TRADEMARK OFFICE

CERTIFICATE OF CORRECTION

PATENT NO. : 6,123,567

DATED : September 26, 2000

INVENTOR(S) : Dale C. McCarthy

It is certified that error appears in the above-identified patent and that said Letters Patent is hereby corrected as shown below:

Column 3, line 42: "an" should read --and--.

Column 5, line 64: "insulaitno" should read --insulation--.

Column 6, line 14: "threads 27" should read --threads 37--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*